US011671741B2

(12) United States Patent
Seiden

(10) Patent No.: US 11,671,741 B2
(45) Date of Patent: Jun. 6, 2023

(54) IN-EAR DETECTION UTILIZING EARBUD FEEDBACK MICROPHONE

(71) Applicant: DSP Group Ltd., Herzliya (IL)

(72) Inventor: Gabriel Seiden, Rehovot (IL)

(73) Assignee: DSP GROUP LTD.

( * ) Notice: Subject to any disclaimer, the term of this patent is extended or adjusted under 35 U.S.C. 154(b) by 0 days.

(21) Appl. No.: 17/936,218

(22) Filed: Sep. 28, 2022

(65) Prior Publication Data

US 2023/0021144 A1 Jan. 19, 2023

Related U.S. Application Data

(63) Continuation of application No. 17/169,317, filed on Feb. 5, 2021, now Pat. No. 11,503,398.

(60) Provisional application No. 62/971,242, filed on Feb. 7, 2020.

(51) Int. Cl.
*H04R 1/10* (2006.01)
*H04R 29/00* (2006.01)

(52) U.S. Cl.
CPC ..... *H04R 1/1041* (2013.01); *H04R 29/00* (2013.01); *H04R 2201/109* (2013.01); *H04R 2400/01* (2013.01)

(58) Field of Classification Search
CPC .. H04R 1/1041; H04R 29/00; H04R 2400/01; H04R 29/001
See application file for complete search history.

(56) References Cited

U.S. PATENT DOCUMENTS

| | | | | |
|---|---|---|---|---|
| 9,838,812 | B1 * | 12/2017 | Shetye | H04R 1/1091 |
| 9,894,452 | B1 * | 2/2018 | Termeulen | H04R 25/453 |
| 10,448,140 | B2 * | 10/2019 | Kumar | G10K 11/17827 |
| 10,462,551 | B1 | 10/2019 | Kemmerer et al. | |
| 10,748,521 | B1 | 8/2020 | Mulvey et al. | |
| 11,032,631 | B2 * | 6/2021 | Kumari | H04R 29/001 |
| 2014/0037101 | A1 | 2/2014 | Murata et al. | |
| 2019/0230426 | A1 | 7/2019 | Chun | |

* cited by examiner

*Primary Examiner* — Jason R Kurr
(74) *Attorney, Agent, or Firm* — Paradice & Li LLP

(57) ABSTRACT

A method for in-ear detection, the method may include transmitting test signals, by a speaker of an earbud, during a test period, and while the earbud is operating at a first operational mode, wherein the test signals comprise at least one first test signal within a first frequency range, at least one second test signal within a second frequency range, and at one third test signal within a third frequency range; wherein the first frequency range, the second frequency range and the third frequency range differ from each other and are within a human auditory range; generating, by a feedback microphone of the earbud, sensed information that is indicative of audio signals sensed by the feedback microphone as a result of the transmitting of the test signals; and determining whether the earbud is located within an ear of a person, wherein the determining is based on the sensed information and a reference out of ear spectrum.

20 Claims, 6 Drawing Sheets

600

IN-EAR DETECTION UTILIZING EARBUD FEEDBACK MICROPHONE

CROSS REFERENCE TO RELATED APPLICATIONS

This application is a continuation of U.S. patent application Ser. No. 17/169,317 filed Feb. 5, 2021, entitled "IN-EAR DETECTION UTILIZING EARBUD FEEDBACK MICROPHONE," which claims priority from U.S. Provisional Patent Application No. 62/971,242, filed Feb. 7, 2020, all of which are assigned to the assignee hereof. The disclosures of all prior Applications are considered part of and are incorporated by reference in this Patent Application.

BACKGROUND

In-ear detection (detection of whether an earbud is inserted into ear of user) is an important feature, which helps save battery power.

There is a growing need to perform effective in-ear detection.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
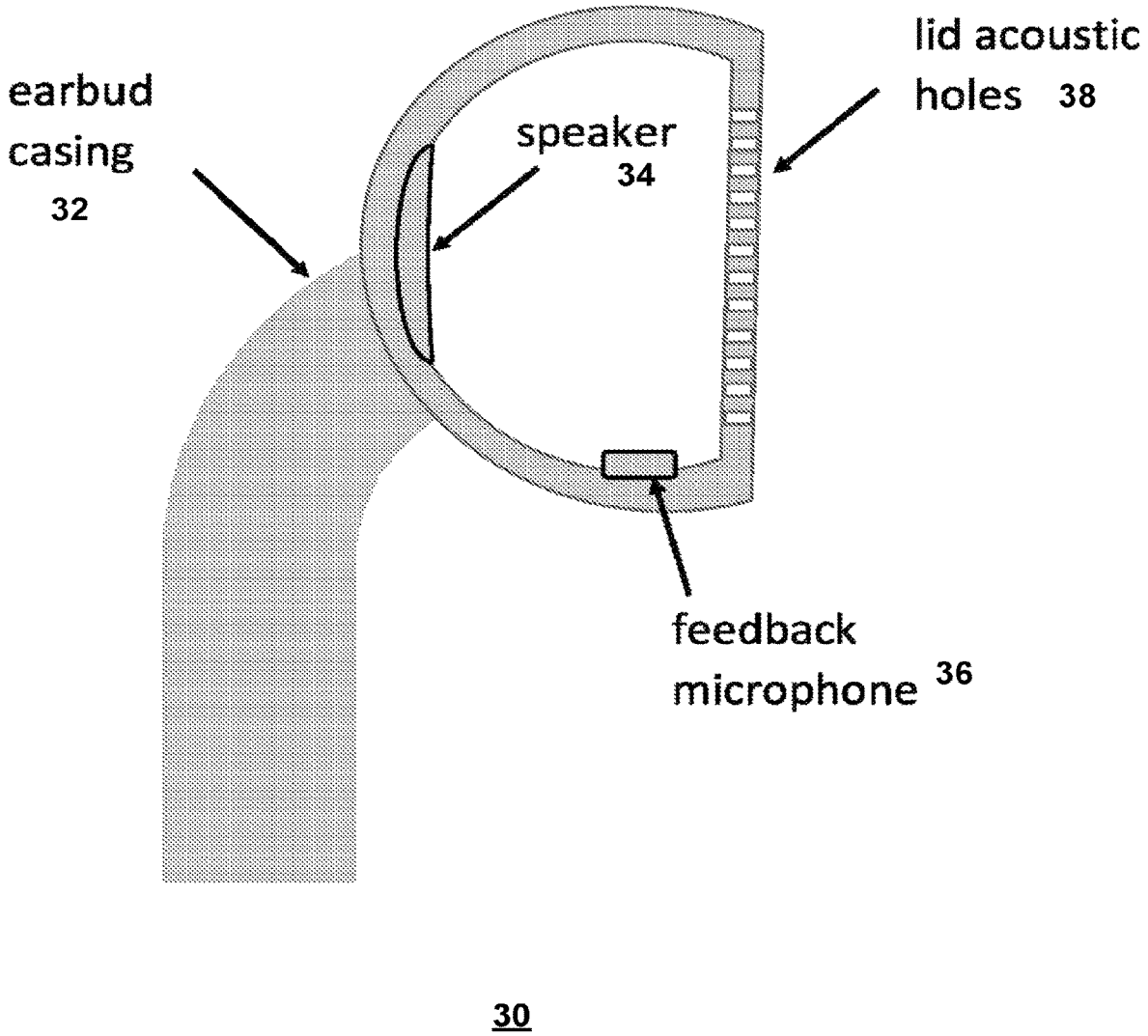
FIG. 1 illustrates an example of an earbud.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Any reference in the specification to a system should be applied mutatis mutandis to a method that can be executed by the system.

Because the illustrated at least one embodiment of the present invention may for the most part, be implemented using micro-electro-mechanical system (electronic) components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

A test signal may be a signal that is generated only for performing the in-ear detection. Alternatively, a test signal may be a signal that is used for testing but is also played for other reasons—for example may be included in music or any other audio that is played to the user regardless of the test.

A test period and an other test period are periods during which the in-ear detection takes place.

In-ear is state in which an earbud is located within an ear canal—for example when the earbud seals or substantially seals the ear canal. Substantially may mean a deviation of 1-20 percent from full sealing. Alternatively—substantially sealed may be obtained by a fulfillment of any sealing criterion, of complying with any sealing parameter defined by the user, the earbud manufacturer and the like.

There may be provided a device, a method and a computer readable medium for in-ear detection.

A portable electronic device, such as a cellular phone, may be coupled to an earbud. Detecting the state of the earbud ('in-ear' or 'out-of-ear') is important with respect to power consumption, as well as to automatic control of related functions pertaining to the portable device (e.g., notification of incoming call, acquisition of bio-sensing information etc.).

Figure 2:
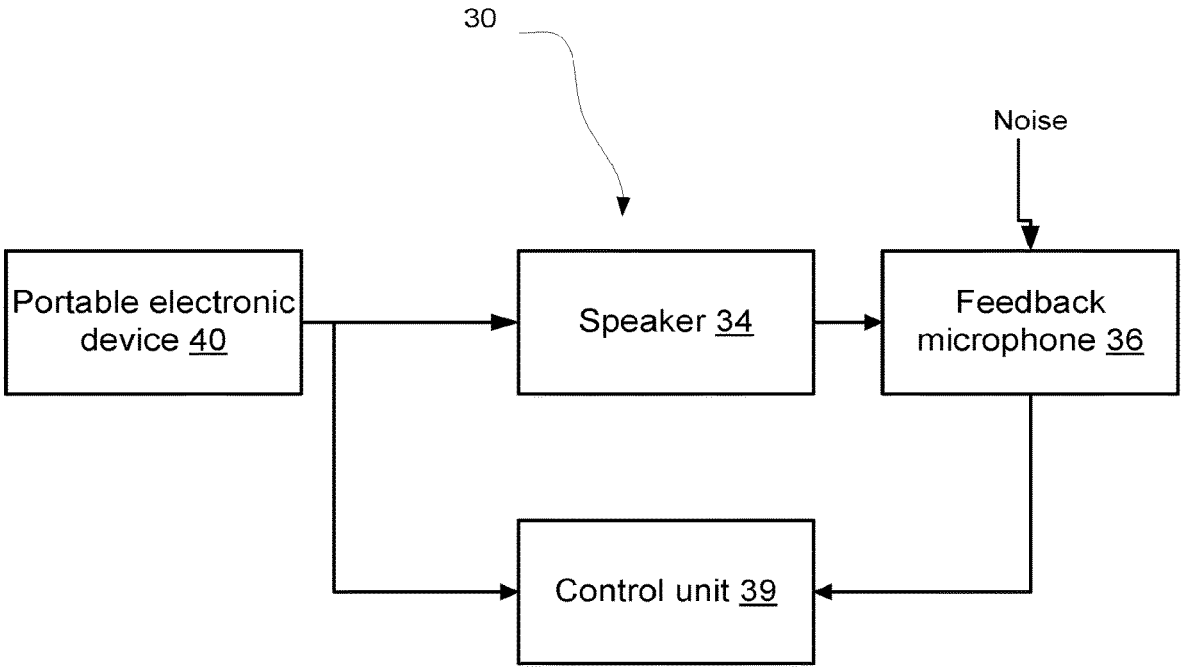
FIG. 2 illustrates a block diagram pertaining to the in-ear detection system.

FIG. 1 illustrates an example of an earbud 30 that include earbud casing 32, speaker 34, feedback microphone 36 and lid acoustic holes 38. FIG. 2 illustrates an example of the earbud 30 (FIG. 2 illustrates speaker 34, feedback microphone 36 and control unit 39 for determining whether the earbud is in-ear of out-of-ear) and a portable electronic device 40. The portable electronic device 40 may sent the speaker 34 input signals that are converted to test signals or candidate test signals. The test signals or candidate ear signals are sensed by feedback microphone 36 (that may also sense noise) to provide sensed information that is sent to the control unit 39. The control unit 39 may also receive the input signals. The control unit may belong to the earbud or may belong to another device, such as the electronic portable device.

Utilizing a feedback microphone, which can also be used for other activities (e.g., ANR/ANC, bio-sensing), makes earbud more compact both geometrically (saves space) and economically (no need for dedicated in-ear detection device, such as IR sensor).

Feasibility of in-ear detection using feedback microphone originates, on the one hand, from the low frequency drop characteristic of free space, and on the other from the ear-canal resonance around 13 kHz. The latter frequency is usually shifted towards lower frequencies (e.g., 10 kHz) due to the presence of the earbud (increase in acoustic-path between source & eardrum).

For both frequency regions, the 'in-ear' sound pressure level (SPL) may be noticeably higher than the corresponding 'out-of-ear' SPL, thus allowing for detection.

Given an earbud that includes (among other elements) of a speaker and feedback microphone, a series of selected frequencies, which will be used for in-ear detection, needs to be determined. These frequencies will generally depend on the geometry of the earbud and, to a lesser degree, on the user's ear-canal. Thus, for optimal determination, the sought frequencies will be determined via an initial probe done when the earbud is first placed in the user's ear. It is assumed that the initial probe is done in noiseless conditions. It is further assumed that a microphone response curve for the reference case of operation in 'out-of-ear', noiseless condition is known (stored).

Figure 3:
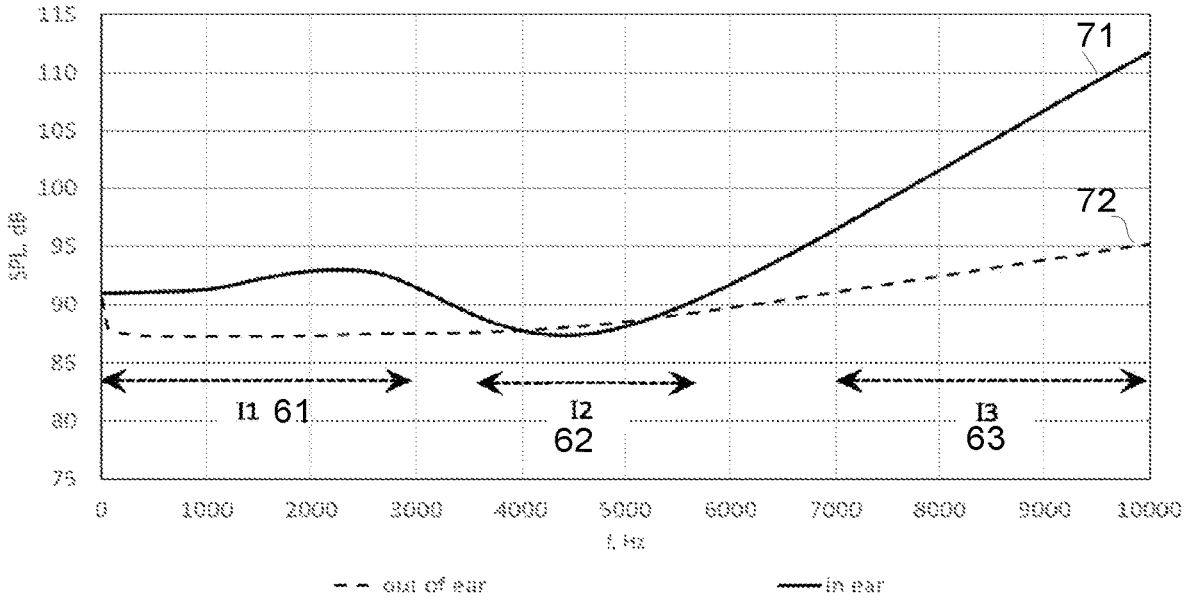
FIG. 3 presents numerical simulation results pertaining to the sound pressure level (SPL) measured by the feedback microphone, for both 'in-ear' and 'out-of-ear' states of an exemplary earbud.

The determination of the sought frequency series $\{f_n\}$ can be done by comparing the already known frequency response curve (reference out of ear spectrum) pertaining to the 'out-of-ear' case with the frequency response pertaining to the results acquired through the initial probe/inspection of the user's ear-canal acoustics. The frequencies are then determined, based primarily on maximum and minimum difference between the two frequency response curves (see FIG. 3 for a typical example of an "in-ear" response curve 71 and an 'out-of-ear' response curve 72 at the first frequency range 61, second frequency range 62, and third frequency range 63). The frequency response curves may be regarded as spectrums.

The former (maximum-difference frequencies) should concentrate at low audio frequencies (e.g., around 100 Hz) as well as in the vicinity of resonance corresponding to the user's ear-canal, while the latter (minimum-difference frequencies) is expected to reside in the intermediate region (e.g., around 5 kHz). We will designate these three frequency intervals by I1, I2 & I3 (i.e., I1 & I3 pertain to maximum-difference between in-ear & out-of-ear responses, and I2 pertains to minimum-difference between responses).

In-ear detection at time instance 't' will be conducted by:

a. Acquiring speaker input voltage and microphone output voltage in time interval: [t-DT, t], where DT is of the order of 0.1 seconds.

b. Evaluating discrete Fourier transform (DFT) of speaker input voltage and feedback microphone voltage at the selected frequencies (denoted $V_n^{(s)}(f_n;t)$ and $V_n^{(m)}(f_n;t)$, respectively), based on the acquired (time-domain) voltages.

c. Evaluating the following two main criteria parameters (two main cost functions), for each of the three designated frequency intervals (I1, I2 & I3):

$$\varepsilon_1^{(i)}(t) = \sum_{n_i=1}^{N_1^{(i)}} \left| \frac{V_{n_i}^{(m)}(f_{n_i};t) - \tilde{V}_{n_i}^{(m)}(f_{n_i};t)}{\tilde{V}_{n_i}^{(m)}(f_{n_i};t)} \right|,$$

$$i = 1, 2, 3;\ \tilde{V}_{n_i}^{(m)}(f_{n_i};t) = P_{n_i} V_{n_i}^{(s)}(f_{n_i};t)$$

$$\varepsilon_2^{(j)}(t) = \sum_{n_j=1}^{N_2^{(j)}} \left| \frac{V_{n_j}^{(m)}(f_{n_j};t) - \hat{V}_{n_j}^{(m)}(f_{n_j};t)}{\hat{V}_{n_j}^{(m)}(f_{n_j};t)} \right|,$$

$$j = 1, 2, 3;\ \hat{V}_{n_j}^{(m)}(f_{n_j};t) = Q_{n_j} V_{n_j}^{(s)}(f_{n_j};t)$$

wherein the pre-factor $P_n$ is based on the known (stored) transfer function between speaker input voltage and microphone output voltage in 'out-of-ear' (free-space), noiseless conditions, and $Q_n$ is based on the initial probe/inspection.

d. The criteria parameters $\varepsilon_1^{(i)}(t)$ are constructed such that in 'out-of-ear', with no background noise, their value is negligible ($\varepsilon_1^{(i)} \approx 0$). However, when 'in-ear', the value of $\varepsilon_1^{(1)}(t)$ & $\varepsilon_1^{(3)}(t)$ should rise noticeably due to the increase in response both at low frequencies and at near resonance frequencies. Likewise, the criterion parameters $\varepsilon_2^{(j)}(t)$ are constructed such that when in 'in-ear', noiseless condition their value is negligible ($\varepsilon_2^{(j)} \approx 0$). However, when out-of-ear, the value of $\varepsilon_2^{(1)}(t)$ & $\varepsilon_2^{(3)}(t)$ is expected to increase noticeably. The parameters $\varepsilon_1^{(2)}(t)$ & $\varepsilon_2^{(2)}(t)$, which pertain to the intermediate frequency range I2 (minimal-difference frequencies), are primarily noise indicators.

e. Based on these criteria, 'in-ear' state is declared if $\varepsilon_2^{(1)}(t), \varepsilon_2^{(3)}(t) \le \delta_2$ & $\varepsilon_2^{(2)}(t) \le \delta_{noise}$ (where $\delta_2, \delta_{noise} \ge 0$ are threshold values).

f. In contrast, if $\varepsilon_1^{(1)}(t), \varepsilon_1^{(3)}(t) \le \delta_1$ & $\delta_1^{(2)}(t) \le \delta_{noise}$ (where $\delta_1 \ge 0$ is a threshold values) the state is declared 'out-of-ear'.

The above two distinct cases of criteria parameter values correspond to the ideal, essentially noiseless limits of operation. When noticeable noise is present, the values of the six criteria parameters may vary from these 'ideal' limits. In order to determine the earbud state in noiseless conditions the following three noise-related aspects can be utilized:

Extent of deviation from criteria threshold. As noted above, each of the two earbud states is characterized by three inequalities. In general, the set of criteria parameters values will be closer to fulfilling one of the two 'ideal' limits. Depending on the noise level and frequency fingerprint, the extent of violation of the corresponding three inequalities can be quantified and form a basis for determining the earbud state.

Number of violated inequalities. The number of violated inequalities is another aspects that may be taken into consideration when determining the earbud state. This number will range between one and three.

Noise characterization using multiple integration time intervals. As noted earlier, the voltage acquisition time interval is of the order of 0.1 s. In case of ambiguity with respect to the earbud state one can use multiple (rather than a single) time interval in order to obtain more information regarding the ambient noise. As an example, the user might tighten the already 'in-ear' earbud—an action which might cause substantial noise. In this case, utilizing multiple acquisition time interval may help determine that the noise is short-lived and that the earbud is still 'in-ear'.

In-ear detection in mute mode. When in 'mute-mode' (speaker not playing), a simplified version of the above detection method will be evaluated, however, not on the basis of an arbitrary/varying audio signal, but rather on the basis of a single frequency tone (e.g., $f_{mute}$=20 Hz or $f_{mute}$=20 kHz) which will be triggered as soon as the 'mute-mode' is activated by the user. In this case the main criteria parameters are:

$$\varepsilon_1^{(mute)}(t) = \left| \frac{V^{(m)}(f_{mute};t) - \tilde{V}^{(m)}(f_{mute};t)}{\tilde{V}^{(m)}(f_{mute};t)} \right|;$$

$$\varepsilon_2^{(mute)}(t) = \left| \frac{V^{(m)}(f_{mute};t) - \hat{V}^{(m)}(f_{mute};t)}{\hat{V}^{(m)}(f_{mute};t)} \right|$$

The threshold values pertaining to the 'mute-mode' scenario might differ from the ones used in the non-mute mode. The first and last of the three aspects presented above for determining the earbud state in the case of noticeable ambient noise are applicable also to the 'mute-mode' scenario.

The frequency tone ($f_{mute}$) is preferably chosen so that it is both within the region where there is a substantial difference between free-space and in-ear acoustic responses, and is undetectable by the user (i.e., either at the lower limit of audio frequencies or at the upper limit of audio frequencies).

Figure 4:
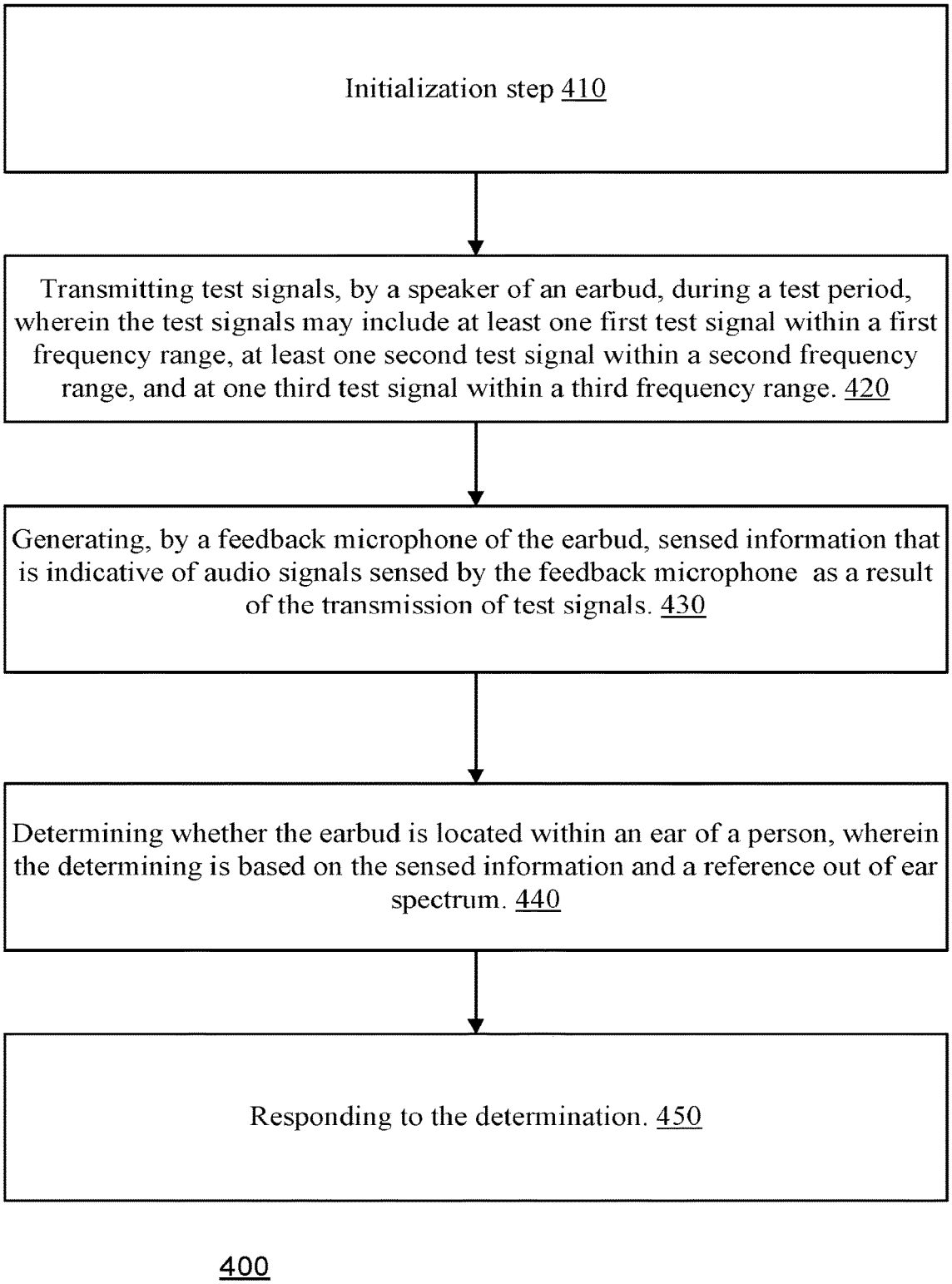
FIGS. 4, 5 and 6 are examples of methods.

FIG. 4 illustrate method 400.

Method 400 may be executed when the earbud is operating at a first operational mode—for example a mode that is not a mute mode.

Method 400 may start by initialization step 410.

Step 410 may include receiving the frequencies of test signals to be transmitted during step 420.

Alternatively—step 410 may include determining the frequencies of the test signals—for example by performing a calibration process.

The calibration process may include positioning the earbud in-ear, generating a candidate test signals, and selecting test signals that once used will provide an indication that the earbud is in-ear.

The selection may be based, on the reception of the test signals and on a reference out-of-ear spectrum of the earbud.

The selection may include selecting test signals that can differentiate between in-ear and out-of-ear states, and also may provide an indication of ambient noise that bias the measurements.

Step 410 may be followed by step 420 of transmitting test signals, by a speaker of an earbud, during a test period, wherein the test signals may include at least one first test signal within a first frequency range, at least one second test signal within a second frequency range, and at one third test signal within a third frequency range.

The at one first test signal may include first test signals having a first plurality of first frequencies within the first frequency range.

The at one second test signal may include second test signals having a second plurality of second frequencies within the second frequency range.

The at one third test signal third test signals having a third plurality of third frequencies within the third frequency range.

The first frequency range, the second frequency range and the third frequency range differ from each other and are within a human auditory range.

The second frequency range may be located between the first frequency range and the third frequency range, wherein the third frequency range may include an estimated ear-canal resonance frequency. The second frequency range may include 5 kHz frequency, the first frequency range may include 500 Hz, and the third frequency range may include 10 kHz.

Step 420 may be followed by step 430 of generating, by a feedback microphone of the earbud, sensed information that is indicative of audio signals sensed by the feedback microphone as a result of the transmission of test signals.

The sensed information may include:

a. A first spectrum of sensed information signals within the first frequency range;
b. A second spectrum of sensed information signals within the second frequency range; and
c. A third spectrum of sensed information signals within the third frequency range.

Step 430 may be followed by step 440 of determining whether the earbud is located within an ear of a person, wherein the determining is based on the sensed information and a reference out of ear spectrum.

Step 440 may include determining that the earbud is located within the ear of the person when the following three conditions are fulfilled:

a. The first spectrum significantly differs from the first reference out of ear spectrum,
b. The second spectrum substantially equals from the second reference out of ear spectrum, and
c. The third spectrum significantly differs from the third reference out of ear spectrum.

Step 440 may include avoiding from determining that the earbud is located within the ear of the person when the second spectrum significantly differs from the second reference out of ear spectrum. In this sense the second frequency range is a safe-guard that may provide an indication of an ambient noise that biases the spectrum.

Step 440 may be followed by step 450 of responding to the determination.

Step 450 may include generating an alert, storing the alert, notifying a control unit or any other device about the status, changing at least one parameter of operation of the earbud, determining a manner for executing the nest sequence of steps 420, 430, 440 and 450, and the like.

At least steps 420, 430, 440 and 450 may be repeated multiple times—for example per user request, according to a predefined schedule, in response to events, and the like.

Figure 5:
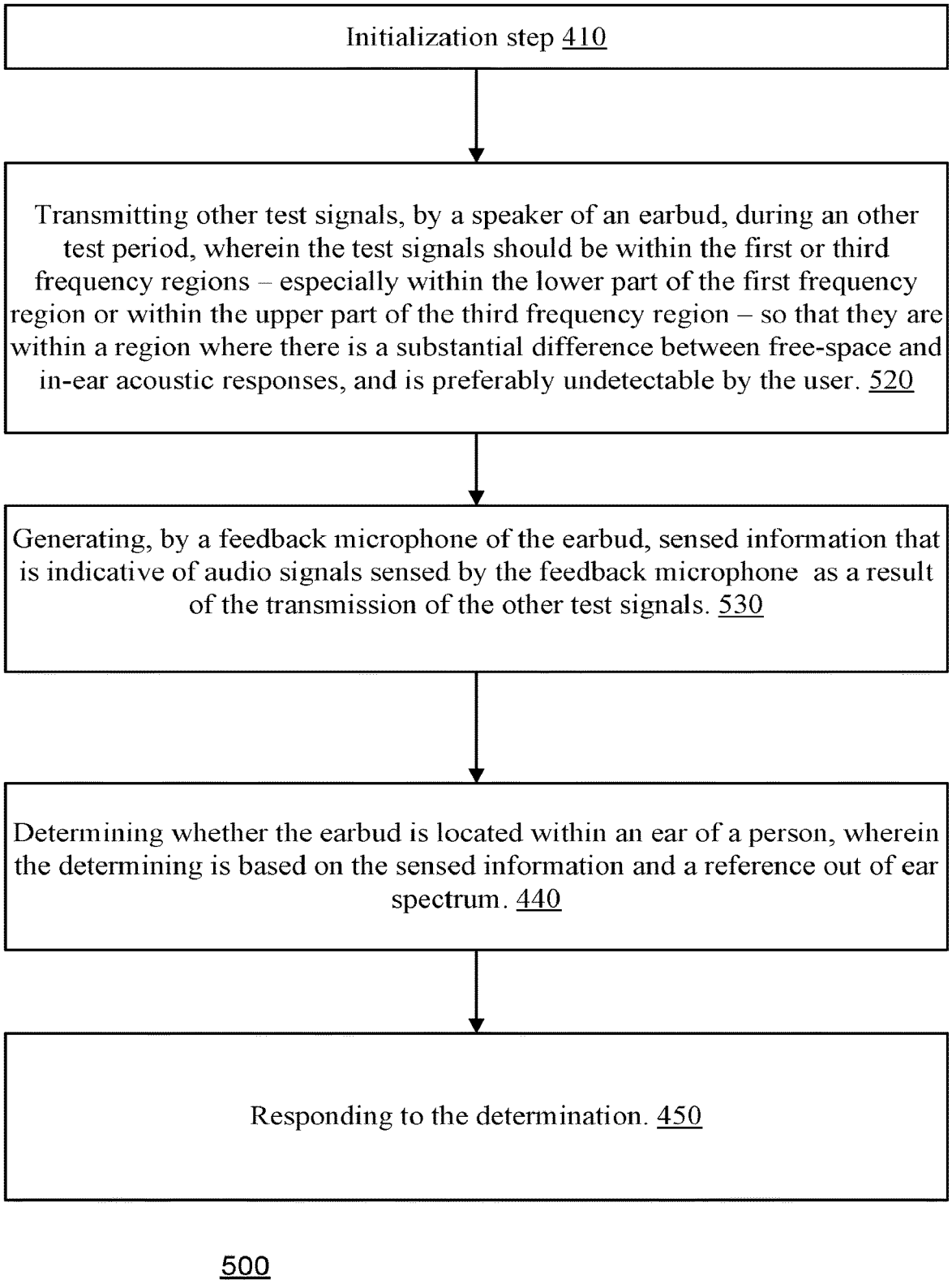

FIG. 5 illustrates method 500 for In-Ear Detection.

Method 500 may start by initialization step 410.

Step 410 may be followed by step 520 of transmitting other test signals, by a speaker of an earbud, during an other test period, wherein the test signals should be within the first or third frequency regions—especially within the lower part of the first frequency region or within the upper part of the third frequency region—so that they are within a region where there is a substantial difference between free-space and in-ear acoustic responses, and is preferably undetectable by the user (e.g., when in mute mode).

Step 520 may be followed by step 530 of generating, by a feedback microphone of the earbud, sensed information that is indicative of audio signals sensed by the feedback microphone as a result of the transmission of other test signals.

Step 530 may be followed by step 440 of determining whether the earbud is located within an ear of a person, wherein the determining is based on the sensed information and a reference out of ear spectrum.

Step 440 may be followed by step 450 of responding to the determination.

Figure 6:
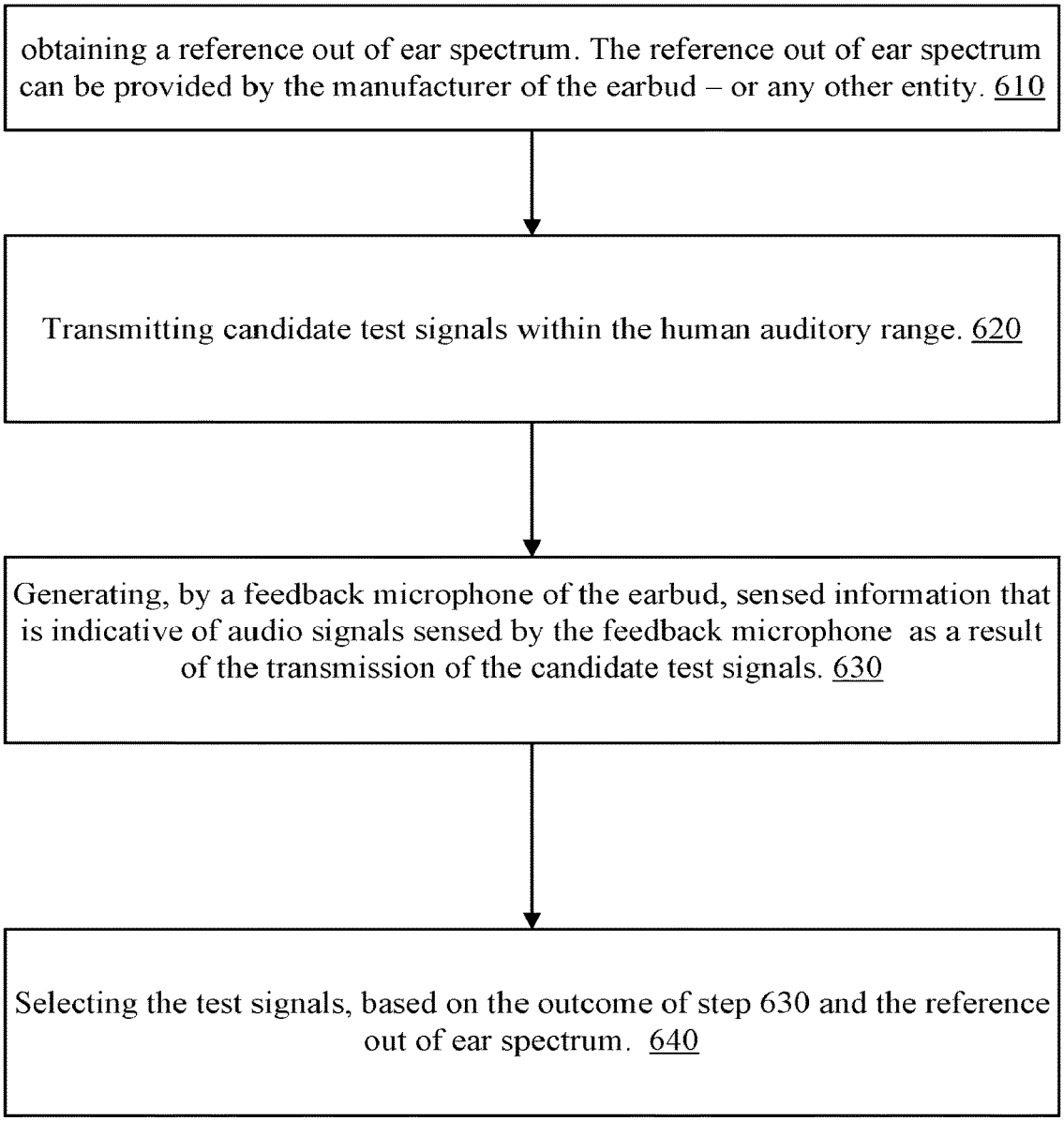

FIG. 6 illustrates calibration process 600.

The calibration process 600 may be included in step 410.

The calibration process 600 may include step 610 of obtaining a reference out of ear spectrum. The reference out of ear spectrum can be provided by the manufacturer of the earbud—or any other entity.

The reference out of ear spectrum may include, for example, first reference out of ear spectrum indicative of sensed information within the first frequency range, second reference out of ear spectrum indicative of sensed information within the second frequency range, and a third reference out of ear spectrum indicative of sensed information within the third frequency range.

Step 610 may be followed by step 620 of transmitting candidate test signals within the human auditory range.

The test signals used in step 420 may be selected out of the candidate test signals—and the candidate test signals should range across the entire human auditory range—or at least enough segment to cover potential first, second and third frequency ranges.

Step 620 may be followed by step 630 of generating, by a feedback microphone of the earbud, sensed information that is indicative of audio signals sensed by the feedback microphone as a result of the transmission of the candidate test signals.

Step 630 may be followed by step 640 of selecting the test signals, based on the outcome of step 630 and the reference out of ear spectrum. The first, second and third frequency ranges may be selected during step 640—either explicitly—or inherently—by selecting the test signals.

The selecting may include determining the frequencies of the test signals in any manner.

Step 640 may include:

a. Selecting the first test signals that once played cause the feedback microphone to sense a first spectrum of sensed information signals within the first frequency range, the first spectrum significantly differs from the first reference out of ear spectrum.

b. Selecting the second test signals that once played cause the feedback microphone to sense a second spectrum of sensed information signals within the second frequency range, the second spectrum substantially equals from the second reference out of ear spectrum.

c. Selecting the third test signals that once played cause the feedback microphone to sense a third spectrum of sensed information signals within the third frequency range, the third spectrum significantly differs from the third reference out of ear spectrum.

Step 640 may include:

a. selecting the first test signals, wherein the selecting may include calculating a first cost function for determining a first difference between the first spectrum and the first reference out of ear spectrum;

b. selecting of the second test signals, wherein the selecting may include calculating a second cost function for determining a second difference between the second spectrum and the second reference out of ear spectrum; and c. the selecting of the third test signals, wherein the selecting may include calculating a third cost function for determining a third difference between the third spectrum and the third reference out of ear spectrum.

There may be provided a device for in-ear detection, the device may include a speaker of an earbud that is configured to transmit test signals, during a test period, and while the earbud is operating at a first operational mode, wherein the test signals comprise at least one first test signal within a first frequency range, at least one second test signal within a second frequency range, and at one third test signal within a third frequency range; wherein the first frequency range, the second frequency range and the third frequency range differ from each other and are within a human auditory range; a feedback microphone of the earbud that is configured to generate sensed information that is indicative of audio signals sensed by the feedback microphone as a result of the transmitting of the test signals; and a control unit that is configured to determine whether the earbud is located within an ear of a person, wherein the determining is based on the sensed information and a reference out of ear spectrum. The control unit may include one or more processing circuits.

There may be provided a device for in-ear detection, the device may include a control unit or a processing unit that may be configured to (a) receive information about input signals sent to a speaker of an earbud that is configured to convert the input signals to transmitted test signals, during a test period, and while the earbud is operating at a first operational mode, wherein the test signals comprise at least one first test signal within a first frequency range, at least one second test signal within a second frequency range, and at one third test signal within a third frequency range; wherein the first frequency range, the second frequency range and the third frequency range differ from each other and are within a human auditory range; (a) receive information about sensed information sensed by a feedback microphone of the earbud that is configured to generate sensed information that is indicative of audio signals sensed by the feedback microphone as a result of the transmitting of the test signals; and (c) determine whether the earbud is located within an ear of a person, wherein the determining is based on the sensed information and a reference out of ear spectrum.

Any reference to any of the terms "comprise", "comprises", "comprising" "including", "may include" and "includes" may be applied to any of the terms "consists", "consisting", "and consisting essentially of".

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between electronic elements are merely illustrative and that alternative embodiments may merge electronic elements or impose an alternate decomposition of functionality upon various electronic elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations are merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single electronic device. Alternatively, the examples may be implemented as any number of separate electronic devices or separate electronic devices interconnected with each other in a suitable manner. However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

I claim:

1. A method for in-ear detection of an earbud, the method comprises:

transmitting, via a speaker of the earbud, a plurality of test signals associated with a plurality of frequency ranges, respectively;

sensing the plurality of test signals via a feedback microphone of the earbud;

determining, based on the sensed test signals, a plurality of spectrums associated with the plurality of frequency ranges, respectively;

determining a deviation of a first spectrum of the plurality of spectrums from a first reference out of ear spectrum;

determining a deviation of a second spectrum of the plurality of spectrums from a second reference out of ear spectrum; and determining whether the earbud is located in a user's ear based at least in part on the deviation of the first spectrum from the first reference out of ear spectrum and the deviation of the second spectrum from the second reference out of ear spectrum, the earbud being determined to be located in the user's ear when the deviation of the first spectrum is greater than a first threshold and the deviation of the second spectrum is less than a second threshold.

2. The method of claim 1, wherein the earbud is determined to be located outside the user's ear when the deviation of the first spectrum is less than or equal to the first threshold.

3. The method of claim 1, further comprising:

determining a deviation of a third spectrum of the plurality of spectrums from a third reference out of ear spectrum, the determination of whether the earbud is located in the user's ear being further based on the deviation of the third spectrum from the third reference out of ear spectrum.

4. The method of claim 3, wherein the earbud is determined to be located in the user's ear when the deviation of the third spectrum is greater than a third threshold.

5. The method of claim 4, wherein the earbud is determined to be located outside the user's ear when the deviation of the first spectrum is less than or equal to the first threshold and the deviation of the third spectrum is less than or equal to the third threshold.

6. The method of claim 3, wherein the frequency range associated with the second spectrum is located between the frequency ranges associated with the first spectrum and the third spectrum.

7. The method of claim 3, wherein the frequency range associated with the third spectrum comprises an estimated ear-canal resonance frequency.

8. The method of claim 3, wherein the frequency range associated with the first spectrum includes a 5 kHz frequency, the frequency range associated with the second spectrum includes a 500 Hz frequency, and the frequency range associated with the third spectrum includes a 10 kHz frequency.

9. The method of claim 1, wherein each of the plurality of test signals has a respective frequency that falls within the associated frequency range, the method further comprising:

selecting the frequencies of the plurality of test signals based at least in part on a calibration process during which the earbud is positioned in a user's ear.

10. The method of claim 1, further comprising:

refraining from determining that the earbud is located in the user's ear when the deviation of the second spectrum is greater than or equal to the second threshold.

11. The method of claim 1, wherein each of the plurality of frequency ranges falls within a range of human auditory frequencies.

12. An earbud comprising:

a speaker configured to transmit a plurality of test signals associated with a plurality of frequency ranges, respectively;

a feedback microphone configured to sense the plurality of test signals; and a control unit configured to:

determine, based on the sensed test signals, a plurality of spectrums associated with the plurality of frequency ranges, respectively;

determine a deviation of a first spectrum of the plurality of spectrums from a first reference out of ear spectrum;

determine a deviation of a second spectrum of the plurality of spectrums from a second reference out of ear spectrum; and determine whether the earbud is located in a user's ear based at least in part on the deviation of the first spectrum from the first reference out of ear spectrum and the deviation of the second spectrum from the second reference out of ear spectrum, the earbud being determined to be located in the user's ear when the deviation of the first spectrum is greater than a first threshold and the deviation of the second spectrum is less than a second threshold.

13. The earbud of claim 12, wherein the earbud is determined to be located outside the user's ear when the deviation of the first spectrum is less than or equal to the first threshold.

14. The earbud of claim 12, wherein the control unit is further configured to:

determine a deviation of a third spectrum of the plurality of spectrums from a third reference out of ear spectrum, the determination of whether the earbud is located in the user's ear being further based on the deviation of the third spectrum from the third reference out of ear spectrum.

15. The earbud of claim 14, wherein the earbud is determined to be located in the user's ear when the deviation of the third spectrum is greater than a third threshold.

16. The earbud of claim 15, wherein the earbud is determined to be located outside the user's ear when the deviation of the first spectrum is less than or equal to the first threshold and the deviation of the third spectrum is less than or equal to the third threshold.

17. The earbud of claim 14, wherein the frequency range associated with the second spectrum is located between the frequency ranges associated with the first spectrum and the third spectrum.

18. The earbud of claim 14, wherein the frequency range associated with the third spectrum comprises an estimated ear-canal resonance frequency.

19. The earbud of claim 12, wherein each of the plurality of test signals has a respective frequency that falls within the associated frequency range, the control unit being further configured to:

select the frequencies of the plurality of test signals based at least in part on a calibration process during which the earbud is positioned in a user's ear.

20. The earbud of claim 12, wherein the control unit is further configured to:

refrain from determining that the earbud is located in the user's ear when the deviation of the second spectrum is greater than or equal to the second threshold.

* * * * *